US008187420B2

(12) United States Patent
Fugitt et al.

(10) Patent No.: US 8,187,420 B2
(45) Date of Patent: *May 29, 2012

(54) METHOD FOR COATING DRY FINISH PAPERBOARD

(75) Inventors: Gary P. Fugitt, Pittsboro, NC (US); Steve G. Bushhouse, Pittsboro, NC (US); Jason Richard Hogan, Glen Allen, VA (US); Wei-Hwa Her, Beaumont, TX (US); Steven Parker, Raleigh, NC (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/225,594

(22) Filed: Sep. 6, 2011

(65) Prior Publication Data

US 2011/0315332 A1 Dec. 29, 2011

Related U.S. Application Data

(63) Continuation of application No. 12/408,197, filed on Mar. 20, 2009, now Pat. No. 8,025,763.

(60) Provisional application No. 61/038,579, filed on Mar. 21, 2008, provisional application No. 61/056,712, filed on May 28, 2008.

(51) Int. Cl.
*D21F 11/00* (2006.01)

(52) U.S. Cl. ..... 162/137; 162/109; 162/135

(58) Field of Classification Search ..... 162/109, 162/135, 137

See application file for complete search history.

(56) References Cited

U.S. PATENT DOCUMENTS

| | | | |
|---|---|---|---|
| 5,320,672 | A | 6/1994 | Whalen-Shaw |
| 5,631,080 | A | 5/1997 | Fugitt |
| 5,861,209 | A | 1/1999 | Haskins et al. |
| 6,582,553 | B2 | 6/2003 | Jewell et al. |
| 6,802,938 | B2 | 10/2004 | Mohan et al. |
| 6,866,906 | B2 | 3/2005 | Williams et al. |
| 7,208,039 | B2 | 4/2007 | Jomes et al. |
| 2004/0065423 | A1 | 4/2004 | Swerin et al. |
| 2005/0039871 | A1 | 2/2005 | Urscheler et al. |
| 2006/0009566 | A1 | 1/2006 | Jones et al. |
| 2006/0060317 | A1 | 3/2006 | Roding et al. |
| 2006/0124033 | A1 | 6/2006 | Pruett et al. |
| 2007/0169902 | A1 | 7/2007 | Brelsford et al. |
| 2008/0311416 | A1 | 12/2008 | Kelly et al. |

FOREIGN PATENT DOCUMENTS

| | | |
|---|---|---|
| JP | 2009-013513 | 1/2009 |
| WO | 1999/067462 | 12/1999 |
| WO | 2002/000998 | 1/2002 |
| WO | 2007/084806 | 7/2007 |

*Primary Examiner* — Mark Halpern

(74) *Attorney, Agent, or Firm* — MWV Intellectual Property Group

(57) ABSTRACT

A method for coating paperboard including the steps of preparing a paperboard substrate having a basis weight of at least about 85 pounds per 3000 $ft^2$, with the proviso that the paperboard substrate is not subjected to a wet stack calendering process, applying a basecoat to at least one surface of the paperboard substrate to form a coated paperboard structure, the basecoat including at least one pigment, the pigment having a sediment void volume of at least about 45 percent, and applying a top coat over the basecoat of the coated paperboard structure to form a top-coated paperboard structure having an outermost coating surface, wherein the outermost coating surface has a Parker Print Surf smoothness of at most about 3 microns.

20 Claims, 12 Drawing Sheets

METHOD FOR COATING DRY FINISH PAPERBOARD

PRIORITY

This patent application is a continuation of U.S. Ser. No. 12/408,197 (allowed) filed on Mar. 20, 2009, which claims priority from U.S. Ser. No. 61/038,579 (expired) filed on Mar. 21, 2008 and U.S. Ser. No. 61/056,712 (expired) filed on May 28, 2008. The entire contents of U.S. Ser. Nos. 12/408,197; 61/038,579 and 61/056,712 are incorporated herein by reference.

FIELD

This patent application is directed to methods for coating paperboard and, more particularly, to methods for coating dry-finish paperboard that result in smooth paperboard structures.

BACKGROUND

Paper or paperboard substrates used for printing and packaging are generally required to have good optical properties, excellent smoothness and excellent printability. Additionally, strength and stiffness are required such that the substrates can pass smoothly through high-speed printing and converting machines without breaking or jamming. High stiffness is necessary for maintaining the structural integrity of paperboard products during filling and in subsequent use.

Stiffness has a close relationship to the basis weight and density of the substrate. For a given caliper (thickness), the general trend is that stiffness increases as basis weight increases. However, if one increases basis weight to improve stiffness, more fiber must be utilized, adding to cost and weight.

In addition to the mechanical properties of stiffness and strength, paper or paperboard substrates that will be printed must have a required level of gloss and smoothness. One of the primary means for obtaining smoothness in a substrate is to calender the substrate during production. Calendering causes a reduction in caliper, which typically results in a corresponding reduction in stiffness. This is especially the case with the process of wet stack calendering. Wet stack calendering requires a rewetting of a sheet that had been previously dried to about 5 percent moisture or less. The now rewetted sheet is passed through a calendering device having two or more rolls. The fiber network is compressed due to the pressure exerted by the rolls. The rewetting of the substrate makes the surface fibers more easily compressed and allows for more aggressive smoothness development. However, this compression densifies the sheet such that product manufactured using a "wet finish" process can have up to a 25% increase in its density after passing through the wet stack calender.

Alternately, manufacturers have attempted to smooth the surface of paperboard by coating the entire surface of the paperboard with a basecoat comprised of various pigments such as clay, calcium carbonate and titanium dioxide and then overcoating this base with a second and sometimes even a third coating, generally referred to as a topcoat. Typically, the more pigment (in the form of pigmented coatings) applied to the surface, the better the resulting smoothness. However, the use of relatively high quantities of pigments usually increases the cost and weight of the paper or paperboard.

The relationship between stiffness and smoothness is generally inversely proportional for a given amount of fiber per unit area. It would be desirable to be able to produce a finished paper or board having a smooth surface that was developed without the need for densification, thereby maintaining maximum thickness with the minimum cellulose fiber usage.

SUMMARY

In one aspect, the disclosed method for coating paperboard may include the steps of preparing a web of cellulosic fibers, the fiber web having a basis weight of at least about 85 pounds per 3000 $ft^2$, calendering the web at least once to form a paperboard substrate, wherein each of the calendering steps is performed without substantially introducing moisture to the web, and applying a basecoat to at least one surface of the paperboard substrate to form a coated paperboard structure, the basecoat including at least one pigment, the pigment having a sediment void volume of at least about 45 percent, wherein the top coated paperboard structure has a Parker Print Surf smoothness of at most about 3 microns.

In another aspect, the disclosed method for coating paperboard may include the steps of preparing a paperboard substrate having a basis weight of at least about 85 pounds per 3000 $ft^2$, with the proviso that the paperboard substrate is not subjected to a wet stack calendering process, and applying a basecoat to at least one surface of the paperboard substrate to form a coated paperboard structure, the basecoat including at least one pigment, the pigment having a sediment void volume of at least about 45 percent, wherein the coated paperboard structure has a Parker Print Surf smoothness of at most about 3 microns.

In another aspect, the disclosed method for coating paperboard may include the steps of preparing a web of cellulosic fibers, the fiber web having a basis weight of at least about 85 pounds per 3000 $ft^2$, calendering the web at least once to form a paperboard substrate, wherein each of the calendering steps is performed without substantially introducing moisture to the web, applying a basecoat to at least one surface of the paperboard substrate to form a coated paperboard structure, the basecoat including at least one pigment, the pigment having a sediment void volume of at least about 45 percent, and applying a top coat to the coated paperboard structure to form a top-coated paperboard structure, wherein the top-coated paperboard structure has a Parker Print Surf smoothness of at most about 3 microns.

Other aspects of the disclosed method for coating paperboard will become apparent from the following description, the accompanying drawings and the appended claims.

DETAILED DESCRIPTION

Disclosed is a method for coating a paperboard substrate with a coating. The coating may include a basecoat and, optionally, one or more intermediate coatings and one or more top coats.

As used herein, "paperboard substrate" broadly refers to any paperboard material that is capable of being coated with a basecoat. Those skilled in the art will appreciate that the paperboard substrate may be bleached or unbleached, with an uncoated basis weight of about 85 pounds per 3000 sq. ft. or more. Examples of appropriate paperboard substrates including linerboard, corrugating medium and solid bleached sulfate (SBS).

In one aspect, the paperboard substrate may be prepared by a continuous production process that utilizes a dry stack calender. In other words, the paperboard substrate may be prepared without the use a wet stack calender.

Figure 11:
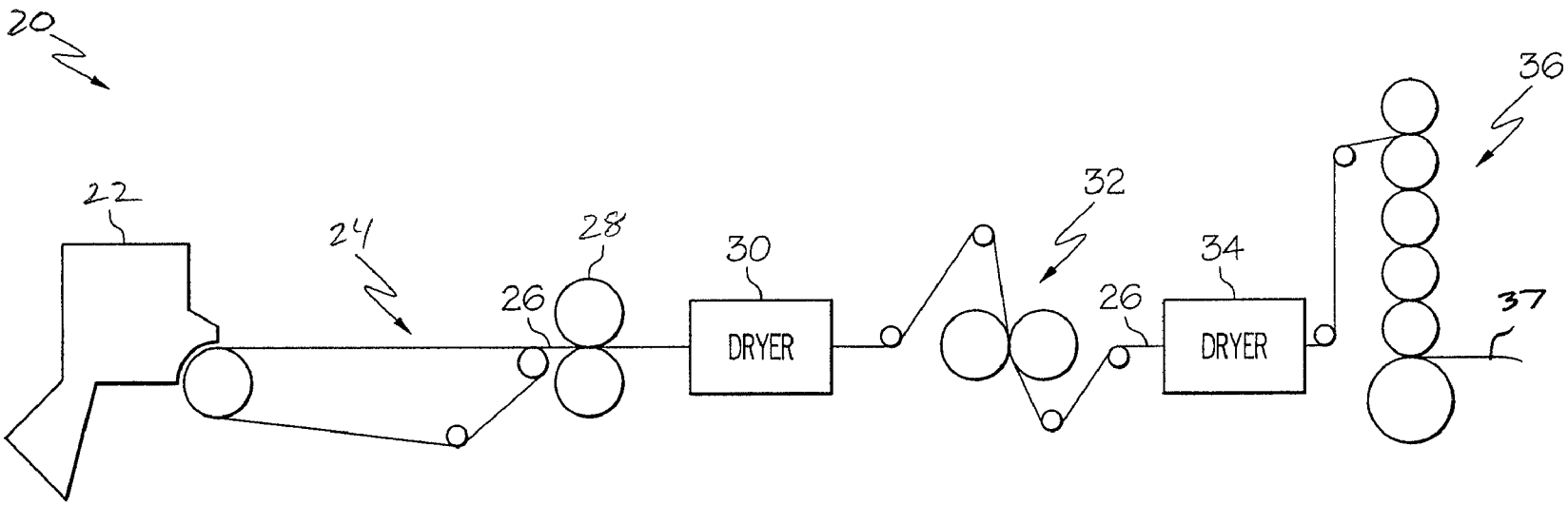
FIG. 11 is a schematic illustration of one aspect of a process for preparing a dry finish paperboard substrate.

Referring to FIG. 11, one aspect of a process 20 for preparing a dry stack paperboard substrate 37 may begin at a head box 22 which may discharge a slurry of cellulosic fiber (with such additives as necessary to improve integrity and functional properties of the substrate) onto a Fourdrinier machine 24, which may include a moving screen of extremely fine mesh, to form a web 26. The web 26 may pass through one or more optional wet presses 28, and then may pass through one or more dryers 30. Optionally, a size press 32 may be used to add functional properties and potentially reduce the caliper thickness of the web 26 and a dryer 34 may then dry the web 26. Finally, the web 26 may pass through a dry stack calender 36 to form the final paperboard substrate 37. The rolls of the calender may be steam heated. The nip loads and number of nips of the calender may be substantially reduced to minimize or avoid reduction in caliper thickness.

Thus, without the paperboard substrate being rewetted at the calender 36, the fiber substrate is only minimally compacted in the calender stack. Therefore, the bulk of the paperboard substrate is not affected to any great extent by the calendering action and the losses in caliper due to densification are minimal prior to coating.

In one aspect, the disclosed basecoat may include a pigment or pigment blend formulated to provide relatively high percent sediment void volumes (i.e., bulkier particle packing) and high smoothness at relatively low coat weights. This high sediment void volume may be obtained via the use of components having relatively high aspect ratios and/or a relatively high average particle size. For example, sediment void volumes in excess of 45 percent may be desired, while sediment void volumes in excess of 47 may be even more desired, while sediment void volumes in excess of 50 may be even more desired.

In one particular aspect, the disclosed basecoat may include a pigment blend of high aspect ratio clay and calcium carbonate. The pigment blend may be dispersed in a carrier, such as water, to facilitate application of the basecoat to an appropriate substrate, such as a paperboard substrate. Additional components, such as binders, stabilizers, dispersing agents and additional pigments, may be combined with the pigment blend to form the final basecoat without departing from the scope of the present disclosure.

The clay component of the pigment blend of the disclosed basecoat may include any platy clay having a relatively high aspect ratio or shape factor (i.e., hyperplaty clay). As used herein, the terms "aspect ratio" and "shape factor" refer to the geometry of the individual clay particles, specifically to a comparison of a first dimension of a clay particle (e.g., the diameter or length of the clay particle) to a second dimension of the clay particle (e.g., the thickness or width of the clay particle). The terms "hyperplaty," "high aspect ratio" and "relatively high aspect ratio" refer to aspect ratios generally in excess of 40:1, such as 50:1 or more, particularly 70:1 or more, and preferably 90:1 or more.

In one aspect, the clay component of the pigment blend may include a platy clay wherein, on average, the clay particles have an aspect ratio of about 40:1 or more. In another aspect, the clay component may include a platy clay wherein, on average, the clay particles have an aspect ratio of about 50:1 or more. An example of such a clay is CONTOUR® 1180 available from Imerys Pigments, Inc. of Roswell, Ga. In another aspect, the clay component may include a platy clay wherein, on average, the clay particles have an aspect ratio of about 90:1 or more. An example of such a clay is XP-6100 also available from Imerys Pigments, Inc. Additional examples of appropriate platy clays are disclosed in U.S. Pat. No. 7,208,039 to Jones et al., the entire contents of which are incorporated herein by reference.

In another aspect, the clay component of the pigment blend may include platy clay having a relatively high average particle diameter. In one particular aspect, the clay component may have an average particle diameter of about 4 microns or more. In a second particular aspect, the clay component may have an average particle diameter of about 10 microns or more. In a third particular aspect, the clay component may have an average particle diameter of about 13 microns or more.

The calcium carbonate component of the pigment blend of the disclosed basecoat may include a calcium carbonate. In one aspect, the calcium carbonate component may include a fine ground calcium carbonate. An example of such a fine ground calcium carbonate is CARBITAL® 95, available from Imerys Pigments, Inc. of Roswell, Ga., wherein about 95 percent of the calcium carbonate particles are less than about 2 microns in diameter. In another aspect, the calcium carbonate component may include a coarse ground calcium carbonate. An example of such a coarse ground calcium carbonate is CARBITAL® 60, also available from Imerys Pigments, Inc., wherein about 60 percent of the calcium carbonate particles are less than about 2 microns in diameter. In another aspect, the calcium carbonate component may include an extra coarse ground calcium carbonate. An example of such an extra coarse ground calcium carbonate is CARBITAL® 35, also available from Imerys Pigments, Inc., wherein only about 35 percent of the calcium carbonate particles are less than about 2 microns in diameter.

In another aspect, the calcium carbonate component of the pigment blend may have an average particle size of about 1 micron or more, such as about 1.5 microns and, more particularly, 3 microns or more.

Without being limited to any particular theory, it is believed that pigment blends that are formulated to provide relatively high percent sediment void volumes (i.e., bulkier particle packing) provide high smoothness at relatively low coat weights, thereby reducing raw material costs. Furthermore, it is believed that using a clay component having a relatively high aspect ratio and/or a relatively high average particle size and a calcium carbonate component having a relatively high average particle size yields relatively high and, therefore, desirable percent sediment void volumes. For example, sediment void volumes in excess of 45 percent may be desired, while sediment void volumes in excess of 47 percent may be more desired and sediment void volumes in excess of 50 percent may be even more desired.

One appropriate technique for measuring sediment void volume includes preparing the pigment or pigment blend and then diluting with water to 50 percent by weight solids to produce a slurry. A 70 gram sample of the slurry is placed into a centrifuge tube and spun at about 8000 g for 90 minutes. The sample is removed from the centrifuge and the clear supernatant liquid is separated and weighed. The sediment is typically packed densely enough that the supernatant liquid is easy to pour off. Based upon the weight of water removed, the amount of water still contained in the voids of the sediment may be calculated. Then, using particle densities, the weight of water in the voids may be converted into percent sediment void volume.

Figure 4:
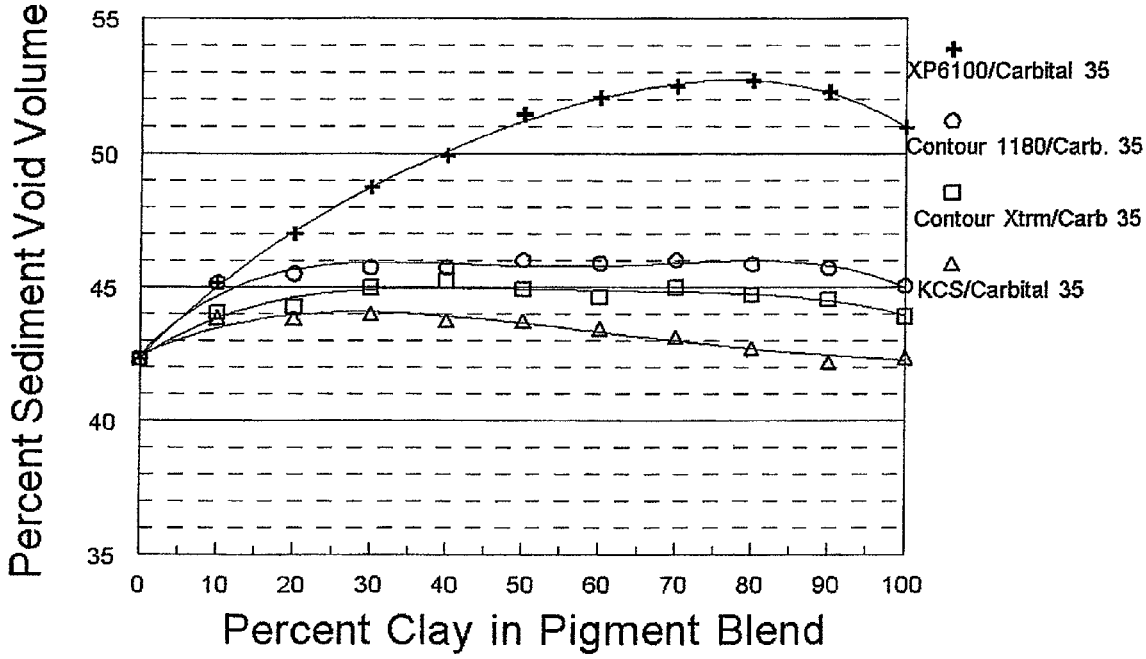
FIG. 4 is a graphical illustration of percent sediment void volume versus percent clay component for various pigment blends formulated with an extra coarse ground calcium carbonate.
Figure 5:
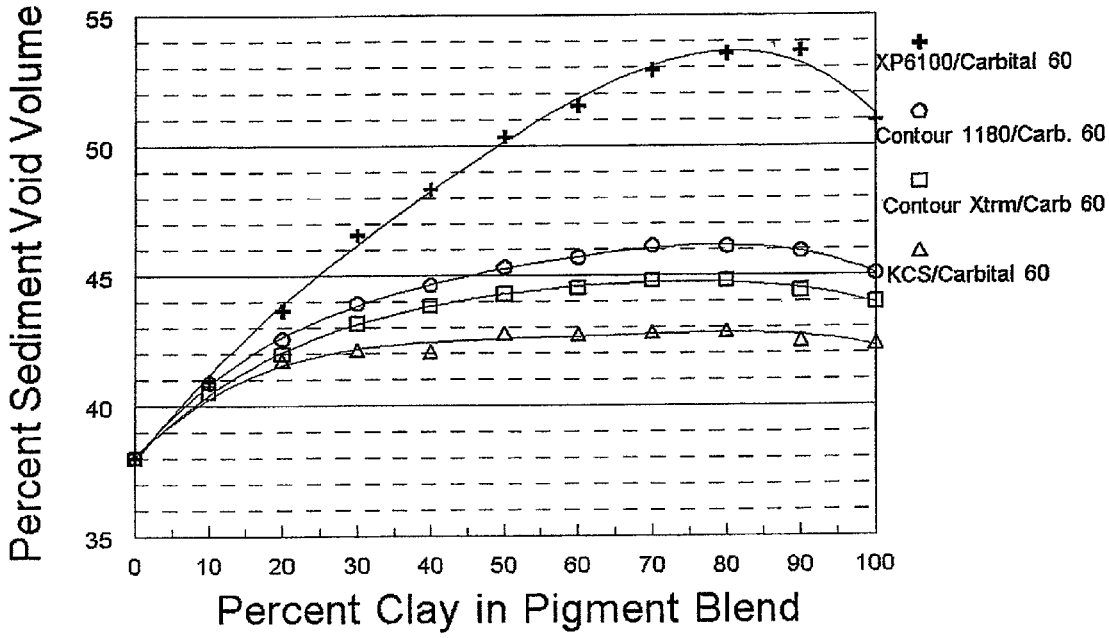
FIG. 5 is a graphical illustration of percent sediment void volume versus percent clay component for various pigment blends formulated with a coarse ground calcium carbonate.
Figure 6:
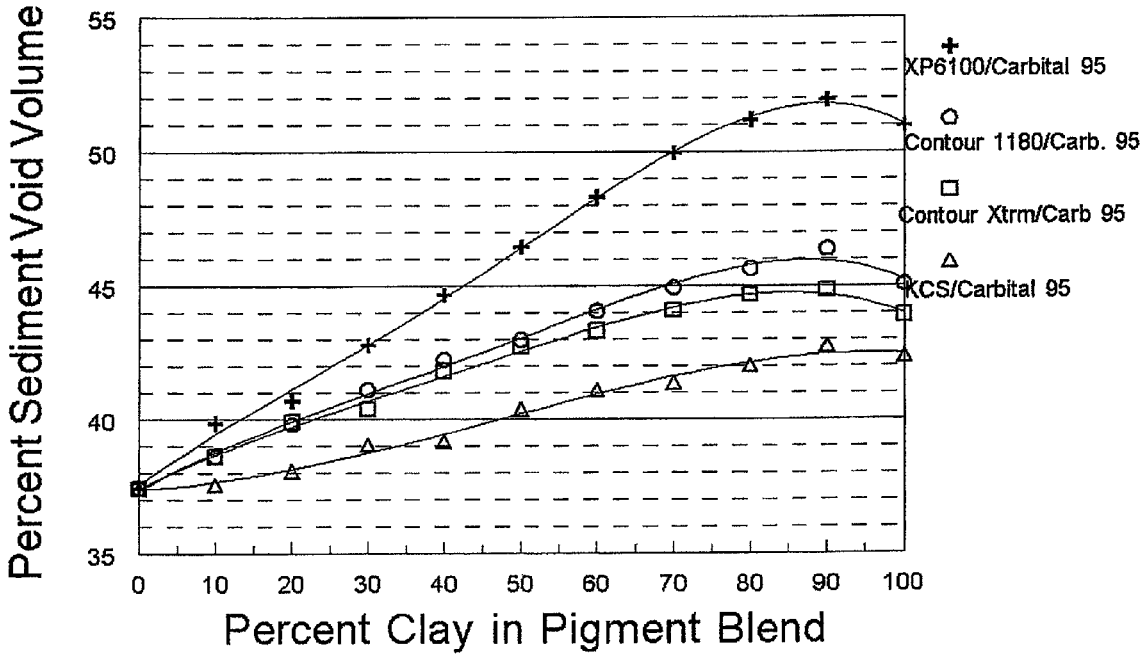
FIG. 6 is a graphical illustration of percent sediment void volume versus percent clay component for various pigment blends formulated with a fine ground calcium carbonate.

Referring to FIGS. 4-6, the percent sediment void volume for various pigment blends versus the percent by weight of the clay component in the pigment blend is provided. Specifically, FIGS. 4-6 compare the use of CARBITAL® 35 (extra coarse), CARBITAL® 60 (coarse) and CARBITAL® 95 (fine) as the calcium carbonate component and XP-6100 (aspect ratio over 90:1), CONTOUR® 1180 (aspect ratio about 50:1), CONTOUR® Xtrm (aspect ratio about 45:1) and KCS (aspect ratio about 10:1 (not a high aspect ratio clay)) as the clay component.

FIGS. 4-6 indicate that coarse ground calcium carbonate (FIGS. 4 and 5), particularly extra coarse ground calcium carbonate (FIG. 4), and high aspect ratio clays, particularly clays having an aspect ratio over 70:1, more particularly over 90:1 (XP-61 00 clay), provide the highest percent sediment void volume.

Furthermore, the concave shape of the curves in FIGS. 4-6, particularly the curves associated with XP-6 100 clay, indicates that maximum percent sediment void volume is achieved when the clay component is blended with the calcium carbonate component. For example, referring to FIG. 4, when extra coarse ground calcium carbonate and XP-6100 are used, maximum percent sediment void volume occurs between about 60 and about 90 percent by weight of the clay component.

Still furthermore, the concave shape of the curves indicates that certain blends of the clay component and the calcium carbonate component provide a percent sediment void volume that is similar, if not higher, than using 100 percent high aspect ratio clay. Therefore, the curves indicate that blending less expensive calcium carbonate with more expensive high aspect ratio clay may yield an equal, if not superior, coating material in terms of percent sediment void volume. Indeed, comparing FIG. 4 to FIG. 6 for example, the curves indicate that the coarser the calcium carbonate, the less high aspect ratio clay must be used to achieve higher percent sediment void volume. For example, referring to FIG. 4, when extra coarse ground calcium carbonate is blended with XP-6 100 clay, a 45:55 blend of the clay component to the calcium carbonate component provides the same percent sediment void volume as 100 percent of the high aspect ratio clay.

Figure 12:
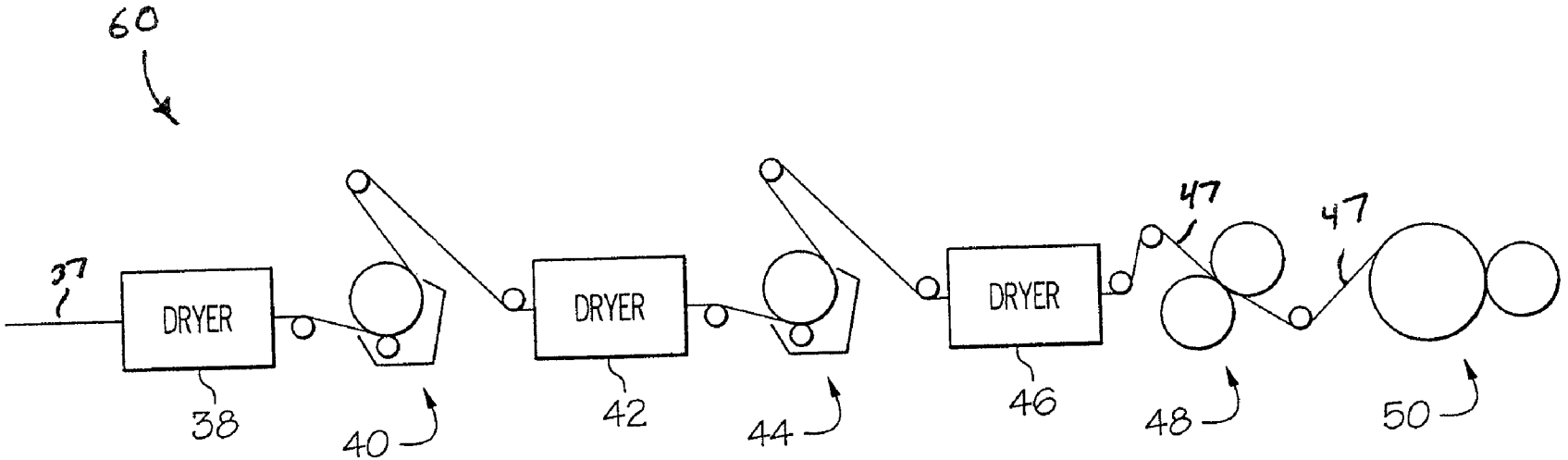
FIG. 12 is a schematic illustration of one aspect of a process for coating the dry-finish paperboard substrate of FIG. 11.

Referring to FIG. 12, one aspect of a process 60 for coating a dry stack paperboard substrate 37 may begin at an optional dryer 38. Then, the dry stack paperboard substrate 37 may pass to a first coater 40. The first coater 40 may be a blade coater or the like and may apply the disclosed basecoat onto the dry stack paperboard substrate 37. An optional dryer 42 may dry, at least partially, the basecoat prior to application of the optional topcoat at the second coater 44. Another optional dryer 46 may finish the drying process before the coated dry stack paperboard substrate 47 proceeds to the optional gloss calender 48 and the coated dry stack paperboard substrate 47 is rolled onto a reel 50.

Figure 7:
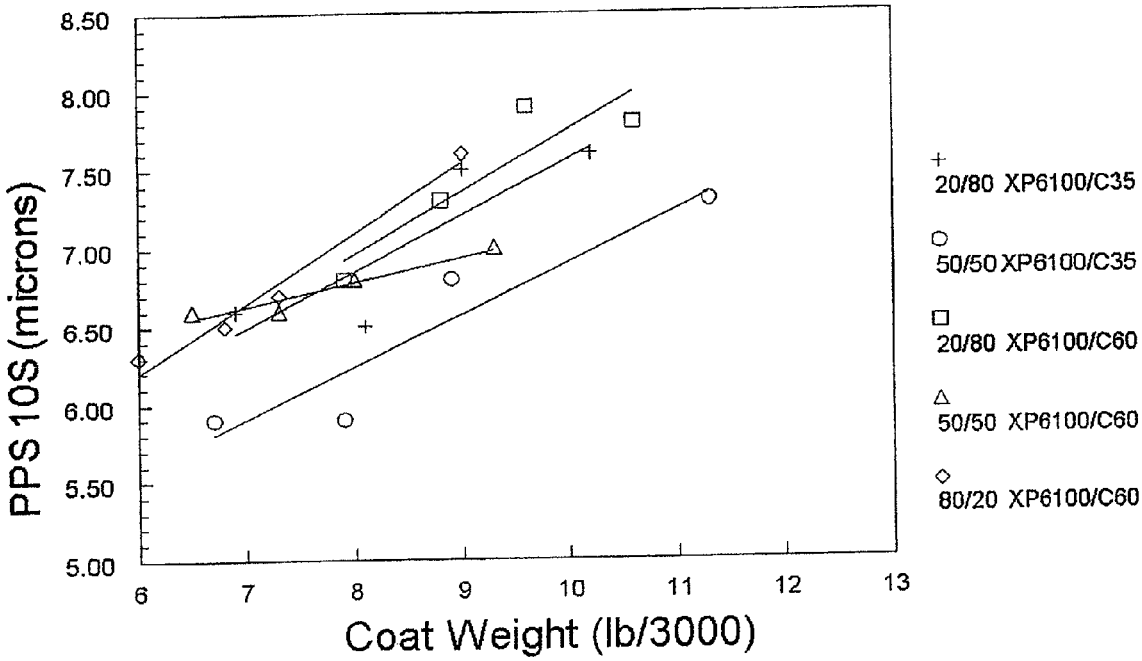
FIG. 7 is a first graphical comparison of Parker Print Surface smoothness versus coat weight for a dry finish, basecoat only paperboard.
Figure 8:
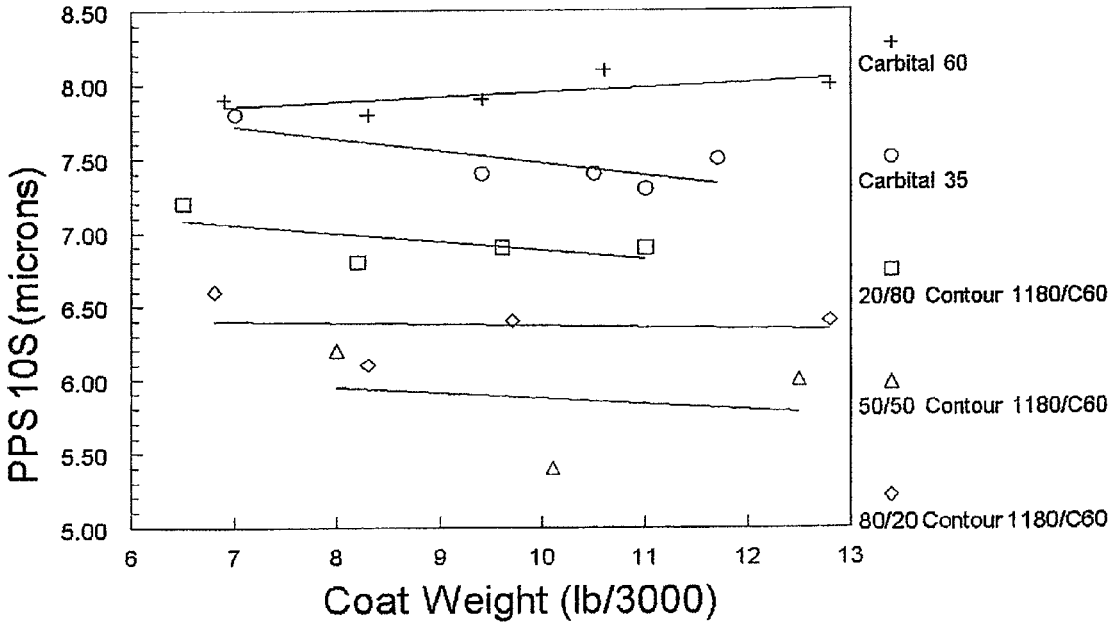
FIG. 8 is a second graphical comparison of Parker Print Surface smoothness versus coat weight for various pigment systems.

Referring to FIGS. 7 and 8, the Parker Print Surface ("PPS") smoothness values of paperboard coated with various basecoats on a pilot coater are presented with respect to the coat weight of the basecoat in pounds per ream (3000 $ft^2$). Those skilled in the art will appreciate that PPS smoothness values taken from samples prepared with a pilot coater are generally higher than the PPS smoothness values obtained from samples prepared on a full scale mill. Nonetheless, the PPS smoothness values taken using a pilot coater are indicative of the improvement provided by the disclosed basecoats over prior art coatings. For reference, when a pilot coater is used, PPS smoothness values of about 7.0 microns or less are generally desired, PPS smoothness values of about 6.5 microns or less are preferred and PPS smoothness values of about 6.0 microns or less are more preferred.

Of particular interest, as shown in FIG. 7, basecoats including coarse or extra coarse calcium carbonate and high aspect ratio clay, particularly XP-6100 clay, provide relatively high percent sediment void volumes and present PPS smoothness values generally below about 7 microns at coat weights of about 9 pounds per ream or less on a paperboard substrate. Indeed, as shown by the positive slope of the curves in FIG. 7, improved smoothness (i.e., lower PPS smoothness value) of the resulting paperboard is directly correlated to lower coat weights. This data is contrary to the expectations of those skilled in the art, which would expect higher smoothness values at high coat weights.

Indeed, when a full scale mill was used, a basecoat including a 50:50 pigment blend of CARBITAL® 35 (extra coarse calcium carbonate) and XP-6100 (high aspect ratio and high average particle size clay) yielded a topcoated PPS smoothness value below about 3 microns, specifically about 2 microns, at a relatively low basecoat weight of 6 pounds per ream.

Accordingly, coating substrates such as paperboard with basecoats comprising ground calcium carbonate, particularly coarse or extra coarse ground calcium carbonate, and high aspect ratio clay, particularly clay having an aspect ratio in excess of about 70:1, more particularly high aspect ratio clay having a relatively high average particle size, yields a smooth paperboard structure without sacrificing bulk, and reduces manufacturing cost by combining more expensive platy clay with less expensive ground calcium carbonate, while requiring surprisingly low coat weights to achieve the desired smoothness.

Furthermore, those skilled in the art will appreciate that the type of high aspect ratio clay selected and the type of ground calcium carbonate selected, as well as the ratio of the clay component to the calcium carbonate component, may be dictated by cost considerations in view of the desired smoothness.

The disclosed basecoats may be applied to the surface of a substrate, such as paperboard (e.g., aseptic liquid packaging paperboard), in a quantity sufficient to fill the pits and crevices in the substrate without the need for coating the entire surface of the substrate. Therefore, the disclosed basecoat together with the disclosed method for applying the basecoat may be used to obtain high surface smoothness with a relatively small quantity of basecoat. Indeed, as discussed above, high surface smoothness may be achieved with an unexpectedly small quantity of the disclosed basecoat.

Figure 9:
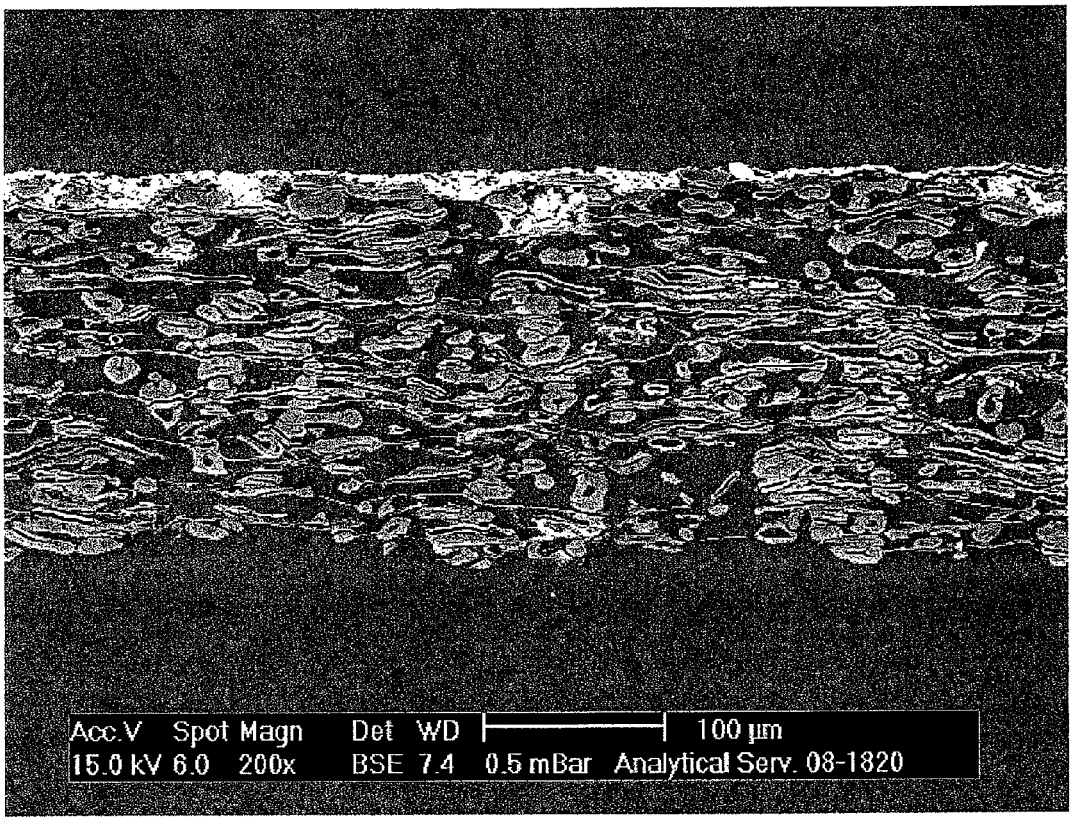
FIG. 9 is a side cross-sectional view of a paperboard substrate coated with the disclosed basecoat according to the disclosed method.
Figure 10:
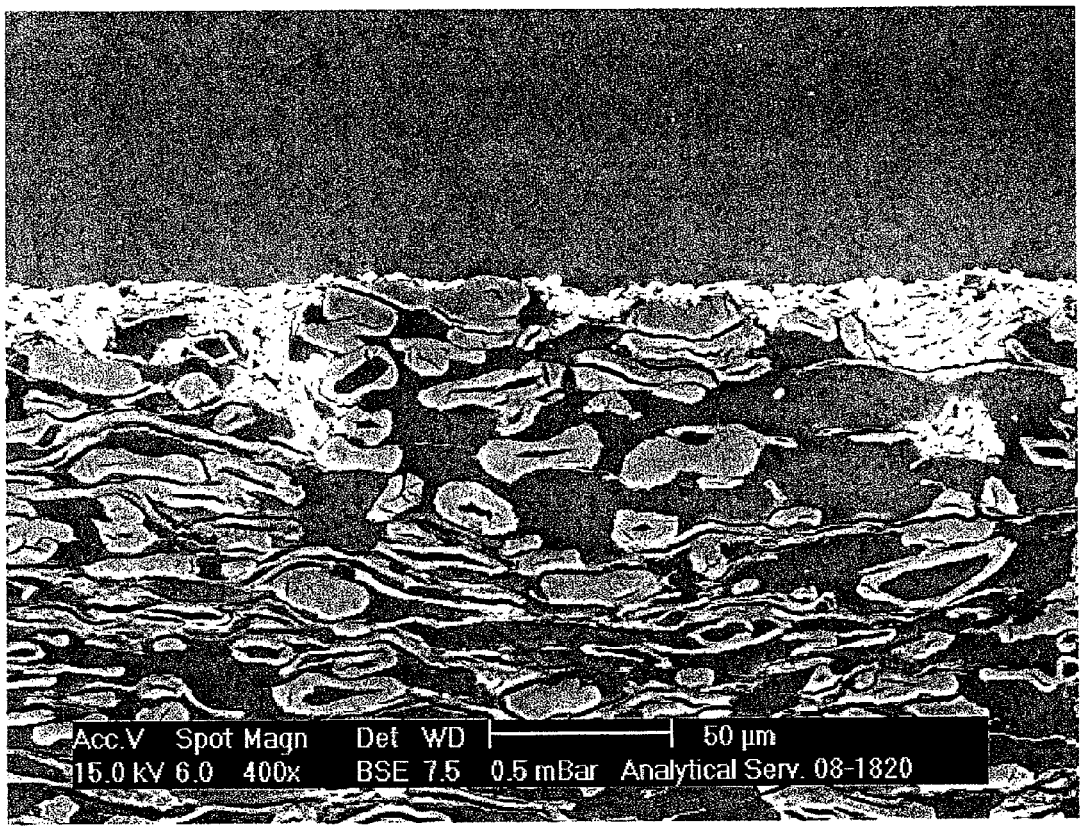
FIG. 10 is a side cross-sectional view of the paperboard substrate of FIG. 9 shown at a second, greater magnification.

In one aspect, the basecoat is applied to the substrate using a blade coater such that the blade coater urges the basecoat into the pits and crevices in the substrate while removing the basecoat from the surface of the substrate. Specifically, as shown in FIGS. 9 and 10, the basecoat may be applied in a manner that is more akin to spackling, wherein substantially all of the basecoat resides in the pits and crevices in the surface of the substrate rather than on the surface of the substrate.

At this point, those skilled in the art will appreciate that when the disclosed basecoat is used in a blade coater, the spacing between the moving substrate and the blade of the coater may be minimized to facilitate filling the pits and crevices in the surface without substantially depositing the basecoat on the surface of the substrate (i.e., forming a discontinuous film on the surface of the substrate). In other words, the blade of the coater may be positioned sufficiently close to the surface of the moving substrate such that the blade of the coater urges the basecoat into the pits and crevices in the surface of the substrate, while removing excess basecoat from the surface of the substrate.

EXAMPLE 1

A first pigment blend prepared according to an aspect of the present disclosure includes 50 percent by weight CARBITAL® 35 (extra coarse ground calcium carbonate) and 50 percent by weight XP-6100 (hyperplaty clay). In a stationary mixer, a coating formulation is prepared by combining the 50:50 pigment blend with water, latex binders and a thickening agent. The water is added in a quantity sufficient to form a slurry. Using a blade coater in the manner described above, the coating formulation is applied to raw paperboard stock having a basis weight of about 126 pounds per 3000 $ft^2$ at the following coat weights: 6.7, 7.9, 8.9 and 11.3 pounds per 3000 $ft^2$. Photographic results are shown in FIG. 3 and the PPS smoothness values are provided in FIG. 7 (data points marked with a circle).

Figure 1:
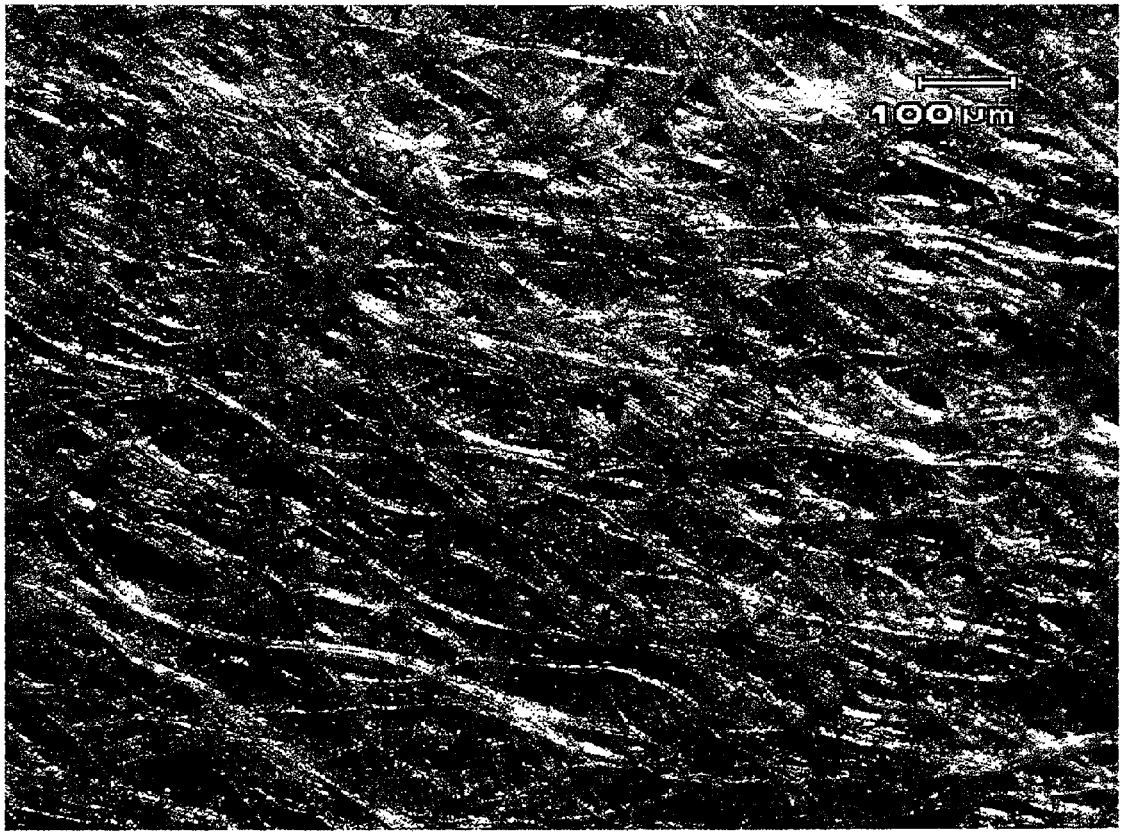
Fig. 1 (Prior Art)
FIG. 1 is a photograph of an uncoated surface of an exemplary paperboard substrate (i.e., raw stock)
Figure 2:
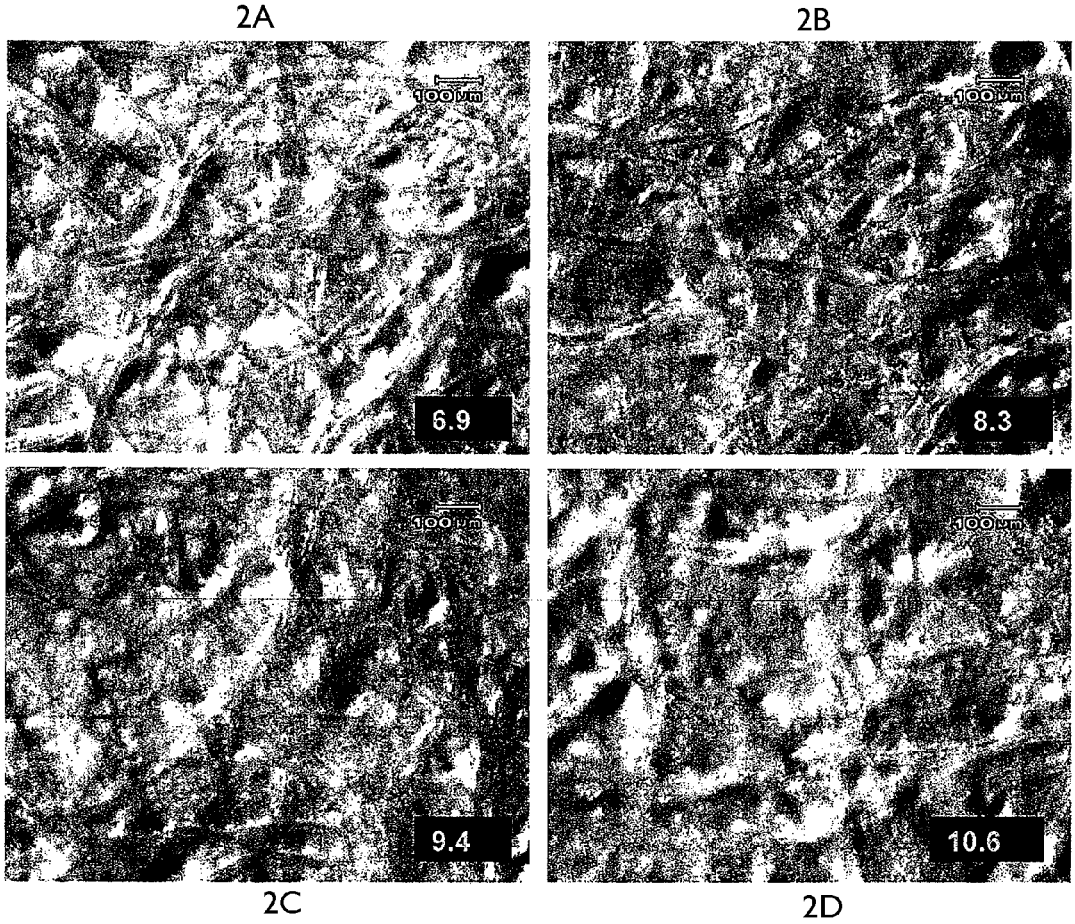
Fig. 2 (Prior Art)
FIGS. 2A-2D are a photographic comparison of the surface of a paperboard substrate coated with various quantities (in pounds per 3000 $ft^2$) of coarse ground calcium carbonate according to the prior art.
Figure 3:
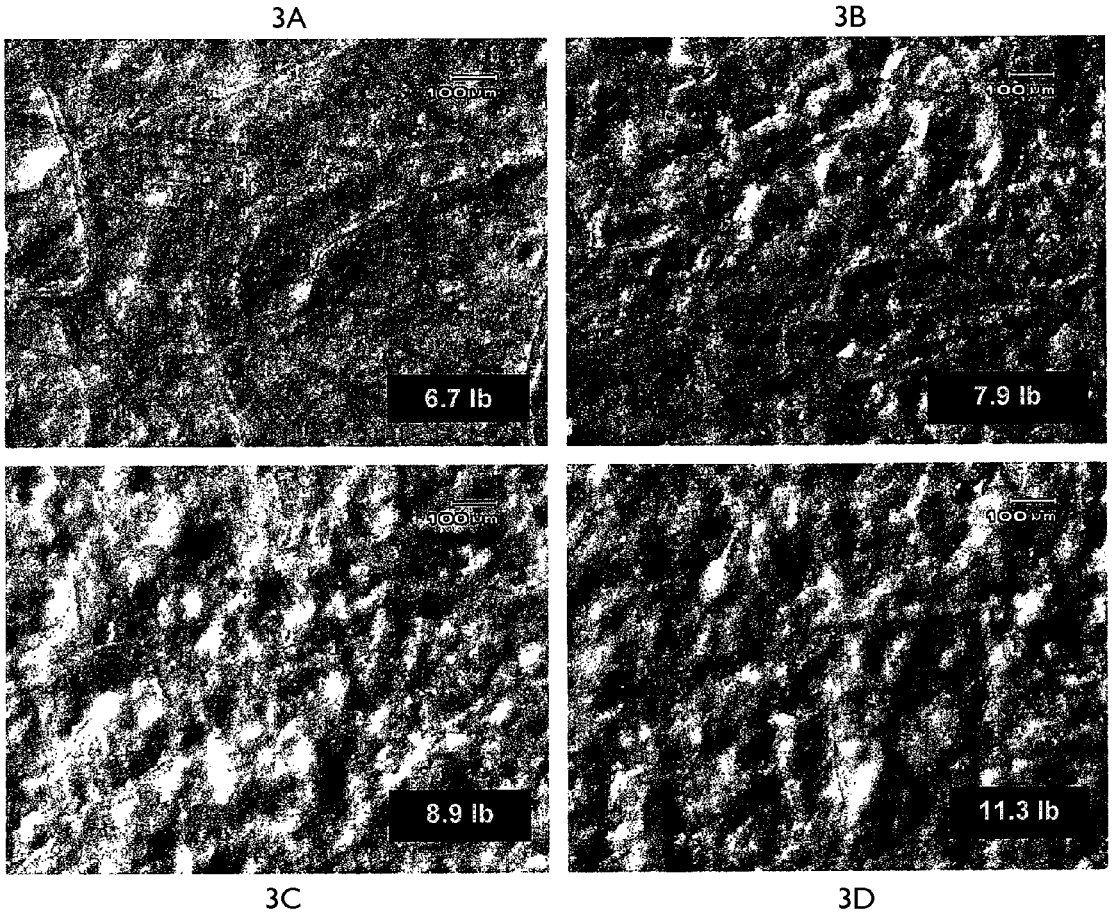
FIGS. 3A-3D are a photographic comparison of the surface of a paperboard substrate coated with various quantities (in pounds per 3000 $ft^2$) of the disclosed basecoat.

Thus, as shown in FIG. 3, the disclosed basecoat and associated method provide optimum smoothness at relatively low coat weights. (Compare FIG. 2 to FIG. 3.) Specifically, the greatest smoothness is achieved at a coat weight of 6.7 pounds per 3000 $ft^2$, with good smoothness achieved at 7.9 pounds per 3000 $ft^2$, with less smoothness at 8.9 pounds per 3000 $ft^2$, and even less smoothness at 11.3 pounds per 3000 $ft^2$.

EXAMPLE 2

A second pigment blend prepared according to an aspect of the present disclosure includes 50 percent by weight OMYA HYDROCARB® 60 (coarse ground calcium carbonate available from Omya AG of Oftringen, Switzerland) and 50 percent by weight XP-6170 (hyperplaty clay available from Imerys Pigments, Inc.). In a stationary mixer, a coating formulation is prepared by combining the 50:50 pigment blend with water, latex and starch binders and a thickening agent. The water is added in a quantity sufficient to form a slurry. Using a blade coater in the manner described above, the coating formulation is applied to raw paperboard stock having a basis weight of about 106 pounds per 3000 $ft^2$ at coat weights of 5.8 and 6.8 pounds per 3000 $ft^2$, thereby providing paperboard structures with improved smoothness at relatively low coat weights.

EXAMPLE 3

A low density uncoated solid bleached sulfate (SBS) board having a basis weight of about 120 lbs/3000 $ft^2$ was prepared using a full-scale production process. The full-scale production process did not include a wet stack calendering process.

A high-bulk, carbonate/clay basecoat was prepared having the following composition: (1) 50 parts high aspect ratio clay from Imerys Pigments, Inc., (2) 50 parts PG-3 from Omya (an extra coarse ground calcium carbonate), (3) 19 parts of a polyvinyl acetate latex (a binder), and (4) an alkali-swellable synthetic thickener in a quantity sufficient to raise the viscosity of the blend to 2500 centipoise, at 20 rpm, on a Brookfield viscometer.

A topcoat was prepared having the following composition: 50 parts fine carbonate; 50 parts fine clay; 17 parts polyvinyl acetate; and minor amounts of coating lubricant, plastic pigment, protein, dispersant, synthetic viscosity modifier, defoamer and dye.

The basecoat was applied to the uncoated board using a trailing bent blade applicator. The basecoat was applied such that the minimal amount of basecoat needed to fill the voids in the sheet roughness remained on the sheet, while scraping the excess basecoat from the sheet to leave a minimum amount of basecoat above the plane of the fiber surface. The basecoat was applied at a coat weight of about 6.0 lbs/3000 $ft^2$. The topcoat was applied over the basecoat to further improve the surface smoothness. The topcoat was applied at a coat weight of about 5.4 lbs/3000 $ft^2$.

The resulting coated structure had a total basis weight of about 130.0 lbs/3000 $ft^2$, a caliper of about 0.012 inches (12 points) and a Parker Print Surf (PPS 10S) smoothness of about 1.5 microns.

Accordingly, at this point those skilled in the art will appreciate that basecoats formulated according to the present disclosure to include coarse ground calcium carbonate, particularly extra coarse ground calcium carbonate, and hyperplaty clay, particularly hyperplaty clays having aspect ratios in excess of about 70:1, and more particularly high aspect ratio clays having a relatively high average particle size (e.g., about 10 microns or more), provide increased surface smoothness at relatively low coat weights, particularly when applied to the substrate using the disclosed method.

While the pigment blends discussed above include platy clay and ground calcium carbonate, particularly extra coarse ground calcium carbonate, those skilled in the art will appreciate that alternative pigment blends may be used without departing from the scope of the present disclosure. For example, the pigment blend of the disclosed basecoat may include a platy clay and one or more additional inorganic pigments other than ground calcium carbonate, such as precipitated calcium carbonate, talc or kaolin clay.

Although various aspects of the disclosed basecoat and associated paperboard structure have been shown and described, modifications may occur to those skilled in the art upon reading the specification. The present patent application includes such modifications and is limited only by the scope of the claims

What is claimed is:

1. A method for coating paperboard comprising the steps of:

preparing a paperboard substrate having a basis weight of at least about 85 pounds per 3000 $ft^2$, with the proviso that said paperboard substrate is not subjected to a wet stack calendering process;

applying a basecoat to at least one surface of said paperboard substrate to form a coated paperboard structure, said basecoat comprising at least one pigment, said pigment having a sediment void volume of at least about 45 percent; and applying a top coat over said basecoat of said coated paperboard structure to form a top-coated paperboard structure having an outermost coating surface, wherein said outermost coating surface has a Parker Print Surf smoothness (PPS 10S) of at most about 3 microns.

2. The method of claim 1 wherein said paperboard substrate is a solid bleached sulfate paperboard substrate.

3. The method of claim 1 wherein said basecoat is applied to said surface of said paperboard substrate at a coat weight, per side, of at most about 9 pounds per 3000 square feet of said paperboard substrate.

4. The method of claim 1 wherein said basecoat is applied to said surface of said paperboard substrate at a coat weight, per side, of at most about 8 pounds per 3000 square feet of said paperboard substrate.

5. The method of claim 1 wherein said basecoat is applied to said surface of said paperboard substrate at a coat weight, per side, of at most about 7 pounds per 3000 square feet of said paperboard substrate.

6. The method of claim 1 wherein said paperboard substrate defines a plurality of pits in said surface, and wherein said step of applying said basecoat comprises applying said basecoat such that said basecoat is substantially received within said plurality of said pits without substantially completely covering said surface.

7. The method of claim 1 wherein said basecoat forms a discontinuous film on said surface of said paperboard substrate.

8. The method of claim 1 wherein said basecoat is applied as a slurry.

9. The method of claim 1 wherein said pigment comprises clay.

10. The method of claim 9 wherein said clay has an average aspect ratio of at least about 40:1.

11. The method of claim 1 wherein said pigment comprises a ground calcium carbonate component and a hyperplaty clay component, wherein said ground calcium carbonate component has a coarse particle size distribution, and wherein said hyperplaty clay component has an average aspect ratio of at least about 40:1.

12. The method of claim 1 wherein said pigment has a sediment void volume of at least about 47 percent.

13. The method of claim 1 wherein said pigment has a sediment void volume of at least about 50 percent.

14. A method for coating paperboard comprising the steps of:

preparing a web of cellulosic fibers, said web having a basis weight of at least about 85 pounds per 3000 $ft^2$ of said web;

calendering said web at least once to form a paperboard substrate, wherein said calendering step is performed without substantially introducing moisture to said web;

applying a basecoat to at least one surface of said paperboard substrate to form a coated paperboard structure, said basecoat comprising a pigment blend, said pigment blend having a sediment void volume of at least about 45 percent; and applying a top coat over said basecoat of said coated paperboard structure to form a top-coated paperboard structure having an outermost coating surface, wherein said outermost coating surface has a Parker Print Surf smoothness (PPS 10S) of at most about 3 microns.

15. The method of claim 14 wherein said pigment has a sediment void volume of at least about 47 percent.

16. The method of claim 14 wherein said pigment has a sediment void volume of at least about 50 percent.

17. The method of claim 14 wherein said outermost coating surface has a Parker Print Surf smoothness (PPS 10S) of at most about 2 microns.

18. The method of claim 14 wherein said outermost coating surface has a Parker Print Surf smoothness (PPS 10S) of at most about 1.5 microns.

19. The method of claim 14 wherein said pigment blend comprises a clay component and a calcium carbonate component.

20. The method of claim 19 wherein said clay component of said pigment blend comprises clay having an average aspect ratio of at least about 40:1.

* * * * *